United States Patent [19]

Cawley

[11] 4,054,233

[45] Oct. 18, 1977

[54] FLUID CONTAINER FOR PHOTOGRAPHIC PROCESSING MATERIAL

[75] Inventor: John Duval Cawley, Rochester, N.Y.

[73] Assignee: Eastman Kodak Company, Rochester, N.Y.

[21] Appl. No.: 683,365

[22] Filed: May 5, 1976

[51] Int. Cl.[2] ..... B65D 35/08

[52] U.S. Cl. ..... 222/107; 96/76 C; 428/194; 428/201; 428/35

[58] Field of Search ..... 526/282; 428/194, 201, 428/354, 355, 500, 522, 35; 96/76 C; 222/107; 206/484

[56] References Cited

U.S. PATENT DOCUMENTS

| | | | |
|---|---|---|---|
| 2,634,886 | 4/1953 | Land | 222/107 |
| 3,056,492 | 10/1962 | Campbell | 206/84 |
| 3,243,416 | 3/1966 | Caldwell | 526/282 |
| 3,438,550 | 4/1969 | Young | 428/430 |
| 3,681,438 | 8/1972 | Starcher et al. | 526/282 |
| 3,833,381 | 9/1974 | Chen et al. | 222/107 |
| 3,833,382 | 9/1974 | Land | 96/76 C |

*Primary Examiner*—William R. Dixon, Jr.
*Attorney, Agent, or Firm*—E. W. Milan

[57] ABSTRACT

Containers or pods for photographic processing material, having strong seals along certain edge areas, and relatively weaker seals along other edge areas. The weaker seals are designed to open and distribute material over a sheet of film and/or paper when pressure is applied within a camera. The weak seal material is a thermoplastic crosslinked homopolymer of a norbornene compound having the structure:

wherein R′ is selected from the group consisting of a hydrogen atom, a monovalent aliphatic group of from 1 to 4 carbons, and a phenyl group, R″ is selected from the group consisting of a hydrogen atom and a monovalent aliphatic group of from 1 to 2 carbons, and *n* is 0 to 3. Seals made with these homopolymers are highly resistant to the dissolving action of aromatic alcohols such as benzyl alcohol.

14 Claims, 3 Drawing Figures

FLUID CONTAINER FOR PHOTOGRAPHIC PROCESSING MATERIAL

BACKGROUND OF THE INVENTION

1. Field of the Invention

This invention relates to edge sealing agents employed in the fabrication of containers or pods containing photographic processing fluid for in-camera developing, and in particular to pods having improved polymeric edge sealing agents that are insoluble in aromatic alcohols.

2. Prior Art

Homopolymers and copolymers suitable for forming the relatively weak burst seal in a pod have been known. Such seal materials are generally located along that edge of a pod which is intended to burst for releasing the photographic developer, and are coated over an inner layer of the pod which is poly(vinyl chloride) or other polymer that resists the developer.

Reference is made to the following representative patents and a publication describing the named seal compositions and others:

3,056,491 — plasticized and unplasticized poly(vinyl butyral); also a composition comprising poly (vinylidene chloride),polyacrylonitrile — poly(vinyl chloride, and an acrylic ester resin.

3,056,492 — cellulose nitrate - acrylic ester resin composition.

3,438,550 — vinylidene chloride - nitrocellulose, ethyl cellulose — acrylic ester resin.

3,750,907 — a mixture of cellulose nitrate or alcohol soluble cellulose acetate butyrate with styrenemethyl methacrylate copolymer or toluene soluble cellulose acetate butyrate or poly(vinyl butyral), a mixture, with a plasticizer, of alcohol soluble cellulose acetate butyrate, or a copolymer of bisphenol A with epichlorohydrin, or toluene soluble cellulose acetate butyrate.

Research Disclosure, November, 1974, Item 12713 poly(2-norbornylmethyl methacrylate).

Poly(cyclohexyl methacrylate-co-5(6)-methyl- -mercapto-2-norbornylmethyl methacrylate).

polyhydroxy ether resulting from copolymerization of bisphenol A with epichlorohydrin.

poly(cyclohexyl methacrylate).

It has long been recognized that some photographic developers contain aromatic alcohols such as those having the formula

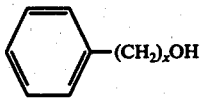

where $x$ is a positive integer from 1 to 3, for example $\beta$ phenylethyl alcohol, $\gamma$-phenyl-n-propyl alcohol, and benzyl alcohol (see U.S. Pat. No. 2,304,925). Another is a,a'-xylenediol. Such aromatic alcohols are solvents for many edge sealing compositions even though present in the photographic formulation to the extent of only about 1–4%. With time the aromatic alcohol dissolves prior compositions, thus allowing contact of the upper and lower poly(vinyl chloride) innermost layers of the pod, and these layers fuse together and form a strong bond that will not break at the desired pressure.

Sometimes it is necessary to apply a small quantity of liquid material in a thin layer over a fairly large surface within a piece of apparatus, such as a camera, without gaining access to the interior of the apparatus. For example, a photosensitive film may be processed or a photograph may be toned by applying on the surface thereof within a camera a layer of a liquid processing reagent, such as a developer for a silver-halide emulsion, or a solution of a toning agent. The present invention makes it possible to apply such a thin layer by incorporating within the apparatus a disposable fluid container in the form of a pod or pouch having at least one wall (and preferably two walls) which is formed of a flexible compressible material, and having sealed edge areas which are relatively weak at one part and relatively stronger at another part for selective opening of the weak seal area while the stronger edge seals are unbroken when the wall is compressed. With this construction, the flexible container wall or walls can be compressed by an internal mechanical device, whereupon the liquid contained within the container is expelled uniformly through the opened weak seal in the desired direction onto the surface to be coated.

It is particularly important that such containers be so constructed as to resist deterioration in storage as the result of chemical action by the contained liquids. Deterioration of the container not only may cause leakage from the container, but also may cause contamination of the contained fluid. Also, action of an aromatic alcohol on the weak edge seal may cause it to become too strong as a result of dissolving the seal composition and permitting the underlying resin areas to fuse together. When this happens, a camera user may find that he cannot successfully develop an exposed film within the camera.

SUMMARY OF THE INVENTION

The principles of the invention depend primarily upon the use of novel sealing compositions which, when locally coated on a part of marginal sealing areas, react to the application of heat and pressure to form seals of lesser strength than the seals between uncoated marginal areas.

I have found that certain thermoplastic polymeric materials, when crosslinked, form excellent relatively weak seals for the bursting edge seals of pods containing photographic developer, which makes such pods especially useful for in-camera film development. Furthermore, the relatively weak seals are insoluble in the presence of an aromatic alcohol and can therefore be employed to advantage as sealants for pods holding photographic developers containing such aromatic alcohols. The polymers of the invention combine such insolubility with the ability to form burst seals of the desired low strength (0.3–0.7 lb/in) over a wide temperature range. Another advantage is their good resistance to changes in strength as they age in storage.

Suitable polymers are prepared from methacrylate esters of norbornene compounds having crosslinkable ethylenically unsaturated groups, and the monomeric structure:

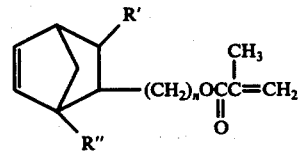

wherein R′ is selected from the group consisting of a hydrogen atom, a monovalent aliphatic group (preferably alkyl) of from 1 to 4 carbons, and a phenyl group, R″ is selected from the group consisting of a hydrogen atom and a monovalent aliphatic group of from 1 to 2 carbons, and $n$ is 0 to 3.

The rings in compounds having the above structure are made by Diels-Alder adducts of cyclopentadiene with variously substituted alcohols. This limits substitution sites to those corresponding to the alcohols used.

A preferred embodiment of the invention employs poly(5-norbornen-2-ylmethyl methacrylate), for simplicity called Polymer N hereinafter:

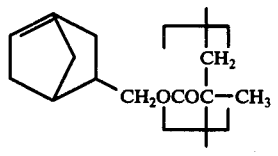

wherein the structure within the brackets represents that of recurring units in the polymer structure.

The polymers of the invention having a suitable degree of polymerization are those having an inherent viscosity in benzene measured at a concentration of 0.25 g/deciliter of solution at 25° C ranging from about 0.1 to 1, preferably 0.02 to 0.8.

Among specific compounds that may be used are:

Poly(5-norbornen-2-yl methacrylate)
Poly(3-methyl-5-norbornen-2-ylmethyl methacrylate)
Poly(2,3-dimethyl-5-norbornen-2-ylmethyl methacrylate)
Poly(3-phenyl-5-norbornen-2-ylmethyl methacrylate)
Poly[2-(3-methyl-5-norbornen-2-yl)ethyl methacrylate]
Poly[2-(2,3-dimethyl-5-norbornen-2-yl)ethyl methacrylate]
Poly[2-(3-phenyl-5-norbornen-2-yl) ethyl methacrylate]
Poly[2-(5-norbornen-2-yl) ethyl methacrylate]
Poly[3-(3-methyl-5-norbornen-2-yl) propyl methacrylate]
Poly[3-(2,3-dimethyl-5-norbornen-2-yl)propyl methacrylate]
Poly[3-(3-phenyl-5-norbornen-2-yl)propyl methacrylate]
Poly[3-(5-norbornen-2-yl)propyl methacrylate]
Poly(3-ethyl-5-norbornen-2-ylmethyl methacrylate)
Poly(2,3-diethyl-5-norbornen-2-ylmethyl methacrylate)
Poly(3-butyl-2-ethyl-5-norbornen-2-ylmethyl methacrylate).

THE DRAWINGS

THE PREFERRED EMBODIMENTS

Figure 1:
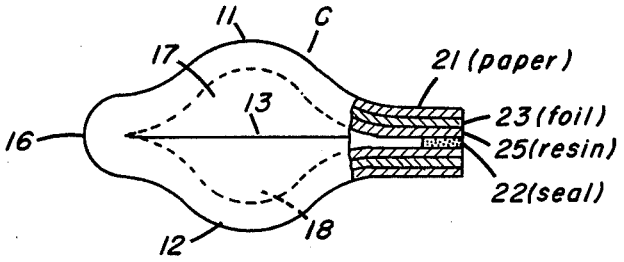
FIG. 1 is a side elevational view, partly broken away and shown in section, of a photographic developer pod in accordance with the invention.
Figure 3:
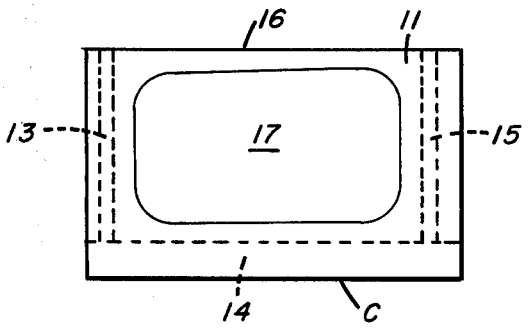
FIG. 3 is a plan view of the pod of FIG. 1.

FIGS. 1 and 3 show a rectangular container C comprising an upper wall 11 and a lower wall 12, both of flexible material, which are sealed together along marginal areas 13, 14, 15 extending around three sides of the container. The fourth side 16 is closed as a fold of the laminated sheet from which the container is formed, but this side also could comprise two edges sealed together when forming the container from separate sheets. The internal areas of the container walls are not sealed together, but are spaced apart to form a storage space for liquid in the form of bubble-like protuberances 17,18 on each side of the container.

Now, referring to FIG. 1, the two flexible walls 11 and 12 are of laminated construction and include several layers which are adhesively joined to one another. Specifically, layer 21 of strong kraft paper is adhered to layer 23 of metal foil, such as lead or aluminum which is impervious to the passage of liquid and to the passage of air from the outside into the liquid. Such paper-foil laminates are generally purchased in sheet form as they are readily available on the market.

The innermost layer 25 is a polymeric resinous material such as poly(vinyl chloride) or a copolymer of vinyl chloride with 2–15 percent by weight of vinyl acetate which is resistant to the action of the contained liquid. Layer 25 can be applied to the foil by extrusion, or solvent coating, or by an adhesive composition. A final layer 22 is the novel sealing composition of the present invention which is coated as a narrow strip along one long edge of the pod where a relatively weak bursting seal is wanted.

The two havles 11 and 12 of the container are joined together along marginal portions 13, 14, 15 by heat and pressure sealing. Where the layers of resin 25 are in contact with one another along edges 13 and 15 a strong seal results such as 2 to 3 lbs/in. Where the strip 22 along edge 14 contacts layer 25, a relatively weaker bursting seal results such as 0.3 to 0.7 lb/in. When the photographic processing liquid is to be expelled through the weak seal on edge 14 by passing a pair of rolls over the container, the nip of the rolls can be positioned at the back edge 16 and moved toward the front edge 14 to break seal 22 and expel the liquid. Success is achieved when the seals at edges 13 and 15 are enough stronger than weak seal 22 to resist bursting.

Instead of coating only one strip 22 along the weak seal edge, both mating edge areas may be similarly coated so that the final seal along that edge is by one strip to the other.

Side 16 need not be sealed at all for operability, although it should be sealed for storage purposes. When back edge 16 is formed by sealing two laminates together, success can be achieved when the seal at edge 16 is stronger, weaker, or the same strength as seal 22. Such a seal on the back edge can be accomplished with the same coating composition as on edge 14 for ease of manufacture. When seals 16 and 22 are by the same alcohol-resistant composition and are of equal strength, the container or pod can be positioned with either edge forward for ease in assembly of film packs or rolls.

Referring again to FIG. 1, even though back edge 16 of the container is closed inherently, it is desirable to pinch and heat seal the adjoining areas together so as to form a strealine design to make it easy to pass a pair of compressing rollers or similar compressing devices across the container.

Instead of sealing the entire length of edge 14 under conditions to form a weak seal, it sometimes is desirable to provide alternate areas of weak and strong sealing to assure uniform distribution of the liquid contents. For example, two areas coated with weak sealing material may be provided, spaced apart by a central or intermediate area of strong sealing material (such as the vinyl polymer or copolymer layer) whereby the liquid is ejected in two separate streams which merge subsequently.

PRACTICE OF THE INVENTION

The following examples relate to crosslinked poly-(5-norbornen-2-ylmethyl methacrylate) useful in the fabrication of pod seals.

EXAMPLE 1 13 Preparation of poly(5-norbornen-2-ylmethyl methacrylate) - Polymer N 5-norbornen-2-ylmethyl methacrylate monomer was prepared in a flask fitted with a vertical condenser with water at 75° C circulating through the jacket, attached at the top to a downwards cold water-cooled condenser. There were refluxed for 2 hours 372 grams (3.0 moles) of 5-norbornen -2-methanol, 450 grams (4.5 moles) of methyl methacrylate, 526 grams of N,N-dimethylformamide, 28.8 grams of hydroquinone, and 8.1 grams (0.15 mole) of sodium methoxide. A total of 252 ml of distillate was collected (theoretical methanol equals 121 ml.). The flask contents were cooled, diluted with ether, and washed with water, excess dilute hydrochloric acid, water, 5% aqueous sodium hydroxide until the washes were colorless, and again with water. The ether solution was dried with anhydrous sodium sulfate, 11.5 grams of p-(p-tolylsulfonyl-amido) diphenylamine were added, and the ether was removed in a rotary evaporator at 60° C and about 15 mm pressure. To the residual oil 0.58 gram of hydroquinone was added and the product was distilled through a Vigreux column to give 431 grams of product having a boiling point of 770 C/1.4 mm, $n_D^{20} = 1.4848$. The monomer was then passed through a column of activated sodium aluminum silicate.

To prepare the polymer, there were refluxed in a 75° C bath for 4 hours 50 g of 5-norbornen-2-ylmethyl methacrylate (free of inhibitors), 100 ml acetone, 100 ml benzene, and 0.5 gram 2,2'-azobis-(2-methylpropionitrile) (AIBN). The reaction mixture was blended with methanol and the solid polymer which had formed was filtered, washed with methanol, and dried in a vacuum at 35° C. The yield was 36.3 g (72.6%), $\{\eta\} = 0.32$ (benzene). (The desirable range for $\eta$ is about 0.2 to 1). This polymer was readily soluble in 100% benzyl alcohol. The polymer had an absorption band in the ultraviolet at 208 nm.

The fact that the double bond in the ring of Polymer N is very reactive has been utilized in four ways in this invention to convert Polymer N to crosslinked compositions which are insoluble in aromatic alcohols. There have been used: (1) energy in the form of heat or light; (2) peroxides or other radical sources as crosslinking initiators; (3) monomercaptans containing functional groups capable of forming hydrogen bonds as crosslinking agents; and (4) bismercaptans as crosslinking agents.

The mechanism of crosslinking by heat or light is not certain, but it is hypothesized that radical sources give free radicals which add to the double bond of the ring giving new free radicals which undergo interchain combinations. Mercaptans add extremely rapidly to the norbornene double bond via a radical chain reaction. If, e.g., mercaptoacetic acid is used, a $-SCH_2CO_2H$ substituent is introduced and crosslinking via interchain hydrogen bonding occurs. Bismercaptans give, via interchain additions, covalently crosslinked products.

Laboratory examples of forming crosslinked materials and testing their resistance to solution in aromatic alcohols follow. The general procedure was to dissolve treated or untreated Polymer N in methylene chloride (5 ml per gram) and cast a film on a glass slide. For the mercaptan addition, a stoichiometric amount of mercaptan was added to the methylene chloride solution immediately before casting a film. The other treatments were done after casting the film.

One half of the slide bearing the film was immersed in 100% benzyl alcohol for 1 hour, then dried in a vacuum at 100° C for 1 hour, and the 2 halves of the slide compared to ascertain the action of the benzyl alcohol. Benzyl alcohol was used as a conveniently available representative of aromatic alcohols. The results appear in Table I below for examples 2 to 9:

| Ex. | Treatment of Polymer N | Action in 100% Benzyl Alcohol |
|---|---|---|
| 2 | Heat at 190° C for 60 sec.* | Insoluble; swells |
| 3 | High pressure Hg lamp,* 30 sec. (a) | Insoluble; swells |
| 4 | Xenon flash, 9.9 kv.,* 50 usec. | Insoluble; swells |
| 5 | Heat 60 sec. at 190° C with 25 mole % di-t-butyl peroxide | Insoluble; swells |
| 6 | Heat 60 sec. at 190° C with 25 mole % AIBN | Insoluble; swells |
| 7 | Heat 60 sec. at 190° C with 25 mole % benzoyl peroxide | Insoluble; not swollen |
| 8 | React with mercaptoacetic acid ($HSCH_2CO_2H$) (b) | Insoluble; swells |
| 9 | React with 1,3-dimercapto-2-propanol ($HSCH_2CHOHCH_2SH$) (c) | Insoluble; not swollen |

*100% poly(5-norbornen-2-ylmethyl methacrylate)
(a) A 30 min. exposure to "black light" UV caused no reaction.
(b) The same result was obtained with mercaptopropionic acid ($HSCH_2CH_2CO_2H$), 2-mercaptoethanol ($HSCH_2CH_2OH$), and 3-mercapto-2-hydroxy propanol ($HSCH_2CHOHCH_2OH$).
(c) 1,2-dimercaptoethane ($HSCH_2CH_2SH$), 1,5-dimercapto-3-oxa-pentane ($HSCH_2CH_2OCH_2CH_2SH$), and 1,5-dimercapto-3-thiapentane($HSCH_2CH_2SCH_2CH_2SH$) reacted similarly.

All the above compositions are suitable because of their insolubility in the aromatic alcohol. The fact that there was swelling in some examples is not significant because the tests were run in 100% benzyl alcohol rather than the much lower concentration to be expected in photographic processing solutions.

Figure 2:
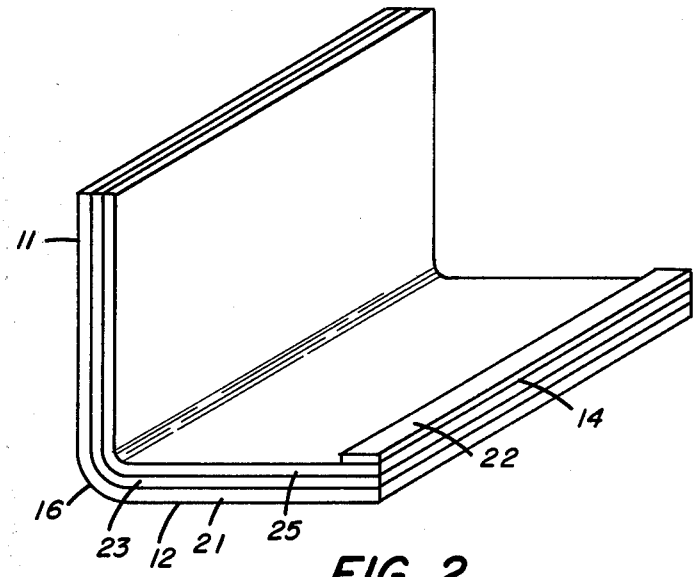
FIG. 2 is a perspective view of a blank which can be folded to form the pod of FIG. 1.

Examples of the application of the above reactions to the fabrication of pods follow. The sealant was machine coated along one long edge of the blank as shown at 22 in FIG. 2 at a level of 160 mg/ft² using a 4% by weight solids solution in methylene chloride, treated and then formed into a pod.

It is an important and unexpected finding that the reaction of Polymer N with mercaptans is concentration dependent with respect to Polymer N. When, for example, a stoichiometric amount of $HSCH_2CHOHCH_2SH$ was added to 100% Polymer N dissolved in $CH_2Cl_2$ (1 gram per 5 ml $CH_2Cl_2$ or 16.7% solids by weight), gelation occurred in 30 min. When the same bismercaptan was added to a 4% by weight solids solution, no gelation was observed after several days. For acceptable results without detrimental gelation it is preferred that the solution contain no more than 10% solids, desirably 1 -10% by weight.

EXAMPLE 10 — Action of Heat

After coating the non-crosslinked Polymer N as described above, and forming a simulated pod weak seal, the weak seal had a burst strength of only 2.4 lbs/in. at the highest seal forming temperature. However, after keeping for 3 days at 145° F. (63° C), strength increased due to crosslinking in situ, and was 0.32 lbs/in. for a seal which had been formed at 275° F (135° C) and 0.47 lbs/in. for a seal formed at 325° F (163° C).

EXAMPLE 11 — Action of Heat

A pod weak seal formed as in Example 10 was heated for 5 minutes at 200° C. The burst strength was increased to 0.34 lbs/in. and 0.54 lbs/in. for seals formed at 300° F (149° C) and 375° F (190° C), respectively.

EXAMPLE 12 — Resistance to Benzyl Alcohol

The described sealant crosslinked Polymer N, was coated and sealed at 300° F (149° C). After 2 weeks in contact with a formulation containing 4% benzyl alcohol, the burst strength was only 0.52 lbs/in., showing that the benzyl alcohol had not dissolved the seal, and thus had not permitted the poly(vinyl chloride) coatings to seal together.

EXAMPLE 13 — Xenon Flash Treatment

The burst strength of the seal of Example 10, formed at 325° F (163° C), was increased from 0.24 lbs/in to 0.40 lbs/in by xenon flashing of Polymer N.

EXAMPLE 14 — Treatment with Di-t-butyl peroxide

Polymer N plus 25 mole percent di-t-butyl peroxide was coated. After keeping at 145° F (63° C) for 3 days to promote a crosslinking reaction the sealing latitude was very good, being 0.35 lbs/in. burst strength for a seal formed at 250° F (121° C) and 0.63 lbs/in. for a seal formed at 325° F 163° C). By sealing latitude I mean the temperature range over which satisfactory burst strengths are achieved.

EXAMPLE 15 — Treatment with Benzol Peroxide

Polymer N crosslinked with 25 mole percent benzoyl peroxide was coated, sealed, and kept 3 days at 145° F (63° C). The sealing latitude was from 0.45 lbs/in. burst strength for a seal formed at 225° F (107° C) to 0.60 lbs/in. for a seal formed at 300° F (149° C).

A second sample was sealed at 375° F (190° C) and stored in contact with a photographic formulation containing 2% benzyl alcohol. After two weeks, burst strength was 0.33 lbs/in. and had remained constant.

EXAMPLE 16 — Treatment with 2,2'azobis(2-methylpropionitrile)

Polymer N crosslinked with 25 mole percent AIBN was coated, sealed, and incubated for 3 days at 145° F (63° C). Sealing latitude was from 0.40 lbs/in burst strength for a seal formed at 225° F (107° C) to 0.73 lbs/in. for a seal formed at 300° F (149° C).

EXAMPLE 17 — Treatment with Mercaptoacetic Acid

To a 4% solids solution of Polymer N in $CH_2Cl_2$ was added $HSCH_2CO_2H$ (0.48 gram per gram of Polymer N — a stoichiometric amount). After edge coating, the pods were sealed and incubated for 3 days at 145° F (63° C) and had the following sealing latitude: 0.30 lbs/in. burst strength for a seal formed at 250° F (121° C) to 0.44 lbs/in. for a seal formed at 325° F (163° C). The formulation within the pod contained one percent benzyl alcohol.

EXAMPLE 18 — Treatment with 1,3-dimercapto-2-propanol

A 4% solids solution in $CH_2Cl_2$ of Polymer N was treated with 0.323 g. of $HSCH_2CHOHCH_2SH$ per gram of Polymer N (stoichiometric amounts). After sealing and keeping at 145° F (63° C) for 3 days the latitude was from 0.31 lbs/in burst strength for a seal formed at 275° F (135° C) to 0.50 lbs/in. for a seal formed at 325° F (163° C).

In another experiment, the pods were sealed after coating at 350° F (177° C) and left in contact with formulation containing 4% benzyl alcohol for 2 weeks, during which the burst strength changed from an initial value of 0.32 lbs/in. to 0.25 lb/in., showing that the seal had resisted solution in the benzyl alcohol.

All the simulated and actual pod seals of Examples 10–18 were found not to increase in their burst strengths to an undesirable extent when subjected to the action of benzyl alcohol.

In contrast to the above examples, seals formed with poly(2-norbornylmethyl methacrylate) described in *Research Disclosure* for November 1974, and left in contact with a formulation containing 2% benzyl alcohol, increased in burst strength from 0.30 lbs/in. to 0.90 lbs/in. in two weeks, an undesirable increase.

Seal burst strengths in the above examples were all determined in an Instron Tensile testing machine. For burst strength, a ½ inch wide strip was cut out perpendicularly to the weak seal. The parts of the strip on opposite sides of the seal were placed in separate jaws of the Instron tensile tester machine, which were then pulled apart until the seal peeled open. The force in pounds was multiplied by 2 to obtain the value in lbs/in.

The invention has been described in detail with particular reference to preferred embodiments thereof, but it will be understood that variations and modifications can be effected within the spirit and scope of the invention.

I claim:

1. In a container for a fluid photographic processing material including aromatic alcohol comprising a pair of opposed walls marginally sealed together over a substantial area to provide an internal cavity adapted to retain such material, at least one of said walls being flexible and deformable, the internal surfaces of said walls bounding said cavity comprising a polymer which resists deterioration by the action of such processing material, said opposed walls being marginally sealed together over a first part of said area polymer-to-polymer, and a polymeric sealing composition interposed between said opposed walls over a second part of said area forming a seal of less strength than the seal over said first part of said area whereby said container preferentially opens along said second part of said area upon the application of pressure to said container, the improvement wherein:

said polymeric sealing composition consists essentially of crosslinked homopolymer of a norbornene compound having the structure:

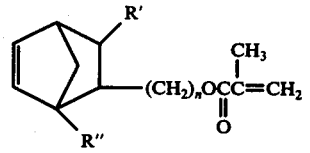

wherein R' is selected from the group consisting of a hydrogen atom, a monovalent aliphatic group of from 1 to 4 carbons, and a phenyl group, R'' is selected from the group consisting of a hydrogen atom and a monovalent aliphatic group of from 1 to 2 carbons, and $n$ is 0 to 3, said homopolymer prior to being crosslinked having an inherent viscosity in benzene measured at a concentration of 0.25 g/deciliter of solution at 25° C ranging from 0.1 to 1, and said seal formed by said polymeric sealing composition between said opposed walls being substantially resistant to changes in burst strength of said seal during storage of said container.

2. In a container in accordance with claim 1, said homopolymer being selected from the group consisting of:

Poly(5-norbornen-2-yl methacrylate)
Poly(3-methyl-5-norbornen-2-ylmethyl methacrylate)
Poly(2,3-dimethyl-5-norbornen-2-ylmethyl methacrylate)
Poly(3-phenyl-5-norbornen-2-ylmethyl methacrylate)
Poly[2-(3-methyl-5-norbornen-2-yl) ethyl methacrylate]
Poly[2-(2,3-dimethyl-5-norbornen-2-yl)ethyl methacrylate]

Poly[2-(3-phenyl-5-norbornen-2-yl) ethyl methacrylate]
Poly[2-(5-norbornen-2-yl)ethyl methacrylate]
Poly[(3-(3-methyl-5-norbornen-2-yl)propyl methacrylate]
Poly[2,3-dimethyl-5-norbornen-2-yl)propyl methacrylate]
Poly[3-phenyl-5-norbornen-2-yl)propyl methacrylate]
Poly[3-(5-norbornen-2-yl) propyl methacrylate]
Poly(3-ethyl-5-norbornen-2-ylmethyl methacrylate)
Poly(2,3-diethyl-5-norbornen-2-ylmethyl methacrylate)
Poly(3-butyl-2-ethyl-5-norbornen-2-ylmethyl methacrylate)

3. In a container in accordance with claim 1, said norbornene compound being 5-norbornen-2 ylmethyl methacrylate.

4. In a container in accordance with claim 1, said polymeric sealing composition consisting essentially of a homopolymer of 5-norbornen-2-ylmethyl methacrylate crosslinked by heat treatment.

5. In a container in accordance with claim 1, said polymeric sealing composition consisting essentially of a homopolymer of (5-norbornen-2-ylmethyl methacrylate) crosslinked by irradiation.

6. In a container in accordance with claim 1, said polymeric sealing composition consisting essentially of a polymer of 5-norbornen-2-ylmethyl crosslinked with di-t-butyl peroxide.

7. In a container in accordance with claim 1, said polymeric sealing composition consisting essentially of a polymer of 5-norbornen-2-ymethyl methacrylate crosslinked with 2,2'azobis(2-methylpropionitrile).

8. In a container in accordance with claim 1, said polymeric sealing composition consisting essentially of a polymer of 5-norbornen-2-ylmethyl methacrylate crosslinked with benzoyl peroxide.

9. In a container in accordance with claim 1, said polymeric sealing composition consisting essentially of a polymer of 5-norbornen-2-ylmethyl methacrylate crosslinked with a mono or bismercaptan.

10. In a container in accordance with claim 9, said 5-norbornen-2-ylmethyl methacrylate polymer and said mono or bismercaptan being crosslinked in about stoichiometrically equivalent amounts.

11. In a container in accordance with claim 9, said polymeric sealing composition being deposited from solution in an organic solvent containing 1 to 10% of said poly(5 norbornen-2-ylmethyl-methacrylate) by weight.

12. In a container in accordance with claim 1 wherein said seal formed by said polymeric sealing composition between said opposed walls has a peel strength of 0.3 to 0.7 lb/in. determined in an Instron Tensile testing machine.

13. In a container in accordance with claim 1 wherein said fluid photographic processing material contains 1% to 4% of said aromatic alcohol.

14. In a container in accordance with claim 13 wherein said aromatic alcohol is benzyl alcohol.

* * * * *

UNITED STATES PATENT OFFICE

CERTIFICATE OF CORRECTION

PATENT NO. : 4,054,233

DATED : October 18, 1977

INVENTOR(S) : John Duval Cawley

It is certified that error appears in the above-identified patent and that said Letters Patent are hereby corrected as shown below:

Column 1, line 26, after "poly(vinyl chloride" insert -- ) --.

Column 4, line 59, change "strealine" to --streamline--.

Column 5, line 9, delete "13".

Column 6, line 65, change "2.4" to -- 0.24 --.

Column 9, line 31, delete "Poly{3-phenyl-5-norbornen-2-yl)propyl methacrylate} and substitute therefore -- Poly{3-(3-phenyl-5-norbornen-2-yl)propyl methacrylate} --.

Signed and Sealed this

*Fourth* Day of *July 1978*

[SEAL]

*Attest:*

RUTH C. MASON
*Attesting Officer*

DONALD W. BANNER
*Commissioner of Patents and Trademarks*